US009821556B2

(12) United States Patent
Suzuki et al.

(10) Patent No.: US 9,821,556 B2
(45) Date of Patent: Nov. 21, 2017

(54) LIQUID EJECTING APPARATUS

(71) Applicant: SEIKO EPSON CORPORATION, Tokyo (JP)

(72) Inventors: Manabu Suzuki, Matsumoto (JP); Tsutomu Sasaki, Matsumoto (JP); Satoru Katagami, Matsumoto (JP); Kazutoshi Fujishima, Azumino (JP); Takahiro Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/065,669

(22) Filed: Mar. 9, 2016

(65) Prior Publication Data

US 2016/0279949 A1 Sep. 29, 2016

(30) Foreign Application Priority Data

Mar. 26, 2015 (JP) ..... 2015-064586

(51) Int. Cl.
*B41J 2/17* (2006.01)
*B41J 2/165* (2006.01)
*B41J 2/175* (2006.01)

(52) U.S. Cl.
CPC ..... *B41J 2/165* (2013.01); *B41J 2/175* (2013.01)

(58) Field of Classification Search
CPC ..... B41J 2/1714; B41J 2/1721; B41J 2/165
See application file for complete search history.

(56) References Cited

U.S. PATENT DOCUMENTS 5,774,141 A * 6/1998 Cooper ..... B41J 2/1714 347/34
2008/0253797 A1* 10/2008 Sakagami ..... B41J 2/1714 399/92
2010/0149297 A1 6/2010 Kanada
2012/0001985 A1 1/2012 Kumagai
2012/0001991 A1 1/2012 Onozawa et al.
2012/0007916 A1 1/2012 Kumagai
2014/0292921 A1 10/2014 Tanaka

FOREIGN PATENT DOCUMENTS

JP 2004-237691 8/2004
JP 2007-229950 9/2007

OTHER PUBLICATIONS

European Search Report for Application No. 16160818.7 dated Sep. 30, 2016.

* cited by examiner

*Primary Examiner* — Jason Uhlenhake
(74) *Attorney, Agent, or Firm* — Workman Nydegger

(57) ABSTRACT

A liquid ejecting apparatus which includes a carriage including an ejecting unit which ejects liquid onto a medium, and can move in a reciprocating direction, in which the carriage includes catching units which catch mist which occurs along with ejecting of the liquid from the ejecting unit on at least one side of the ejecting unit in the reciprocating direction, and the catching units include a fan which moves the mist from the catching units by generating an air current.

10 Claims, 18 Drawing Sheets

LIQUID EJECTING APPARATUS

BACKGROUND

1. Technical Field

The present invention relates to a liquid ejecting apparatus.

2. Related Art

In the related art, a liquid ejecting apparatus which ejects liquid such as ink onto a medium such as a medium for recording has been disclosed. In such a liquid ejecting apparatus, there is a case in which mist of the liquid is attached to an ejecting unit of the liquid, or the like, is accumulated, and the mist contaminates a medium by dripping on the medium. For this reason, a technology in which attaching of liquid to an ejecting unit, or the like, is suppressed is disclosed.

For example, in JP-A-2007-229950, and JP-A-2004-237691, a liquid ejecting apparatus which includes a collecting unit which collects mist of ink which occurs along with ejecting of ink from an ejecting unit is disclosed. In addition, the liquid ejecting apparatuses in JP-A-2007-229950, and JP-A-2004-237691 have a configuration of performing recording by causing a carriage including an ejecting unit to reciprocate in a reciprocating direction.

The liquid ejecting apparatuses in JP-A-2007-229950, and JP-A-2004-237691 can preferably collect mist of ink which occurs along with ejecting of ink from an ejecting unit. However, when it is possible to catch mist of liquid which occurs along with ejecting of the liquid from an ejecting unit immediately after the occurrence, the mist can be further effectively collected.

SUMMARY

An advantage of some aspects of the invention is to catch mist of liquid which occurs along with ejecting of the liquid from an ejecting unit immediately after the occurrence.

According to an aspect of the invention, there is provided a liquid ejecting apparatus including a carriage which includes an ejecting unit which ejects liquid onto a medium, and can move in a reciprocating direction, in which the carriage includes a catching unit which catches mist which occurs along with ejecting of the liquid from the ejecting unit on at least one side of the ejecting unit in the reciprocating direction, and the catching unit includes a fan which causes the mist to move from the catching unit by generating an air current.

In the liquid ejecting apparatus, the catching unit may be extended in an intersecting direction which intersects the reciprocating direction, and a catching port may be provided on a side facing the medium.

In the liquid ejecting apparatus, the fan may be provided on one end side of the intersecting direction, and may be able to blow air toward the other end side from the one side.

In the liquid ejecting apparatus, the fan may be able to blow air toward a direction far from the medium.

The liquid ejecting apparatus may further include a collecting unit of the mist on the downstream side in a movement direction of the mist using the fan.

In the liquid ejecting apparatus, the collecting unit may include a collecting port of the mist, and a suctioning unit which generates an air current from the collecting port toward the inside of the collecting unit, and a wind velocity of an air current which goes toward the collecting port using the fan may be lower than a wind velocity of an air current which goes toward the inside of the collecting unit from the collecting port using the suctioning unit.

In the liquid ejecting apparatus, the catching unit may be formed in a tapered shape on the downstream side in the movement direction of the mist using the fan.

In the liquid ejecting apparatus, the fan may be possible to be driven so that a wind velocity when the carriage is stopped is higher than a wind velocity when the carriage is moving in the reciprocating direction.

According to the aspects of the invention, it is possible to catch mist of liquid which occurs along with ejecting of the liquid from an ejecting unit immediately after the occurrence of mist.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to one embodiment as a liquid ejecting apparatus of the invention will be described in detail with reference to accompanying drawings.

First, an outline of a recording apparatus 1 according to the embodiment of the invention will be described.

Figure 1:
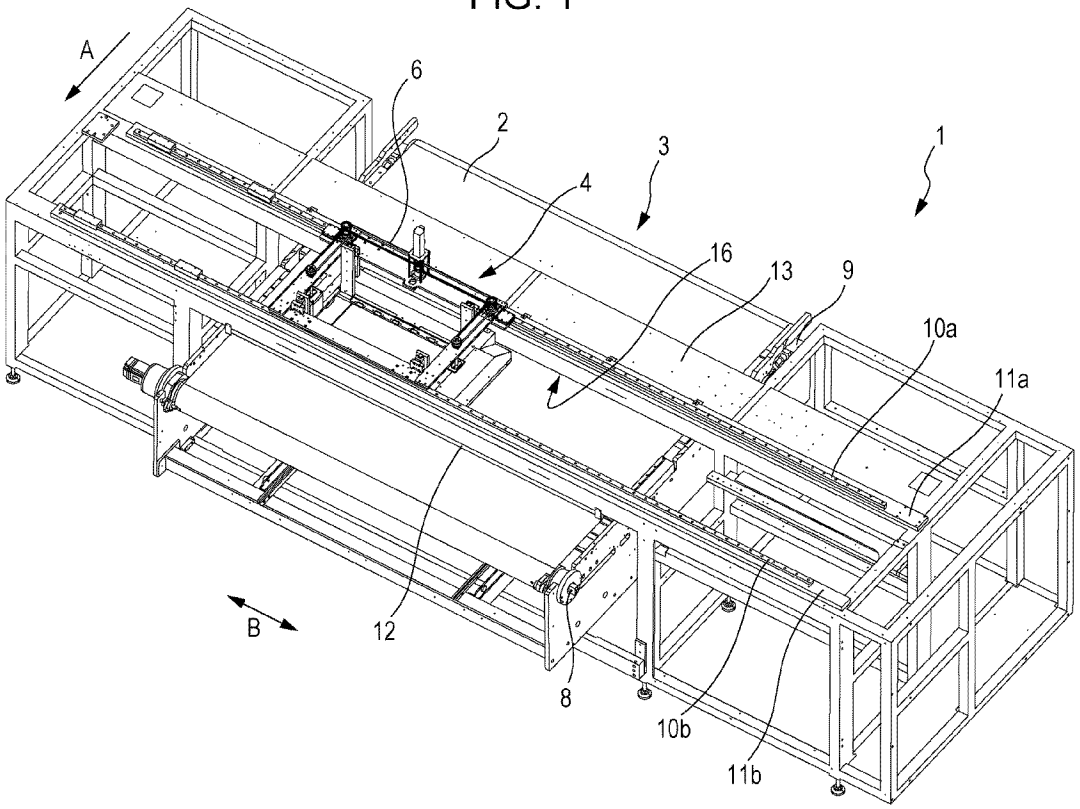
FIG. 1 is a schematic perspective view which illustrates a recording apparatus according to one embodiment of the invention.
Figure 2:
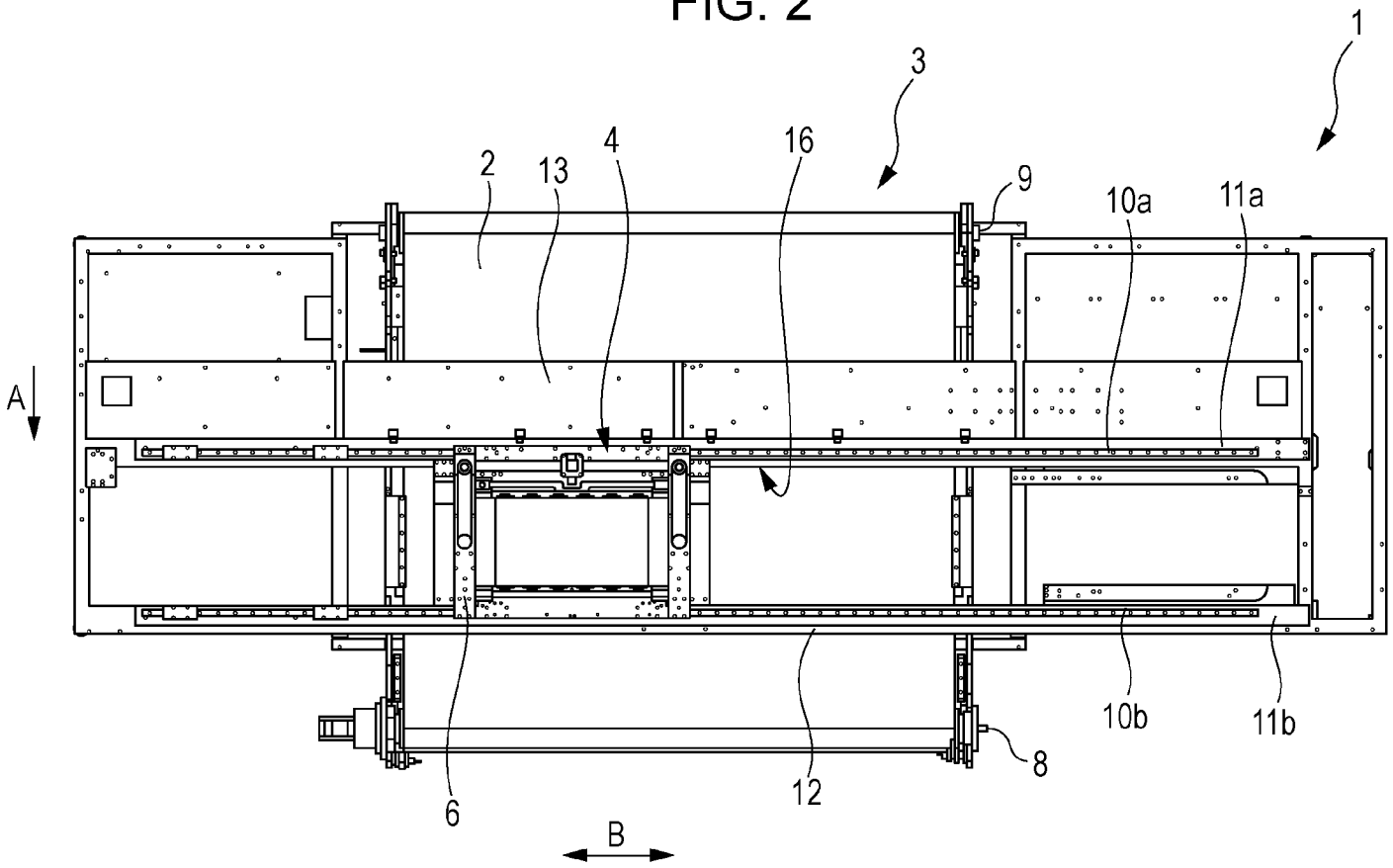
FIG. 2 is a schematic plan view which illustrates the recording apparatus according to the embodiment of the invention.
Figure 3:
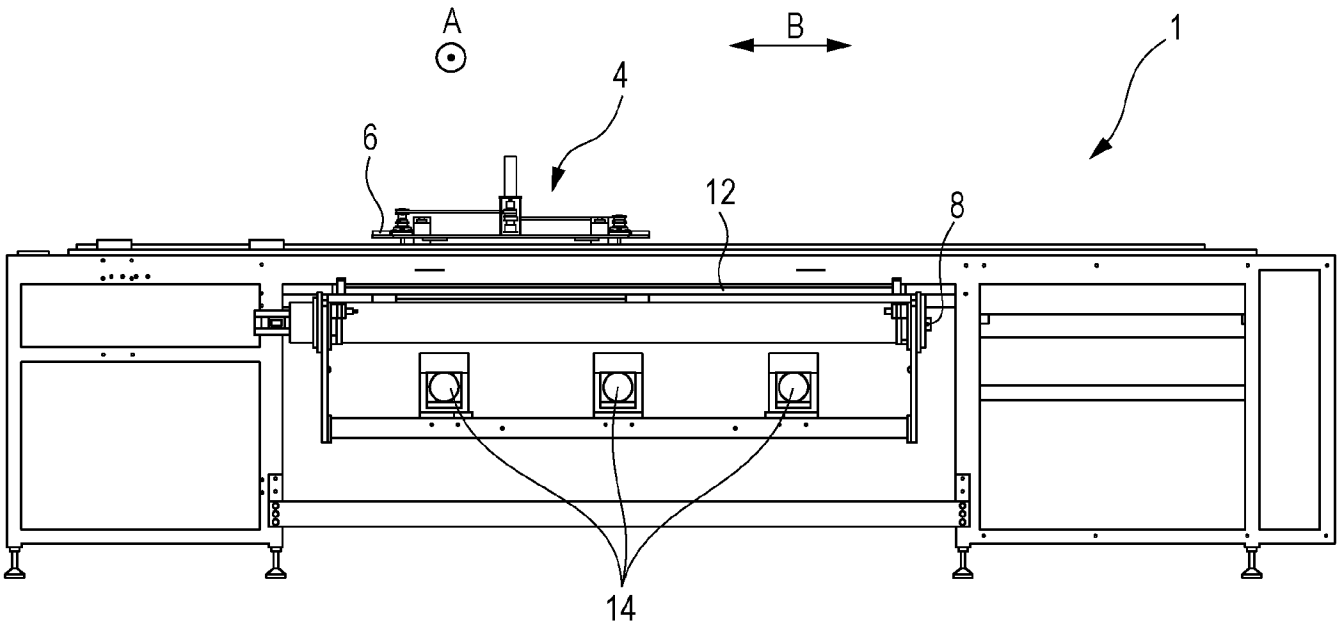
FIG. 3 is a schematic front view which illustrates the recording apparatus according to the embodiment of the invention.
Figure 4:
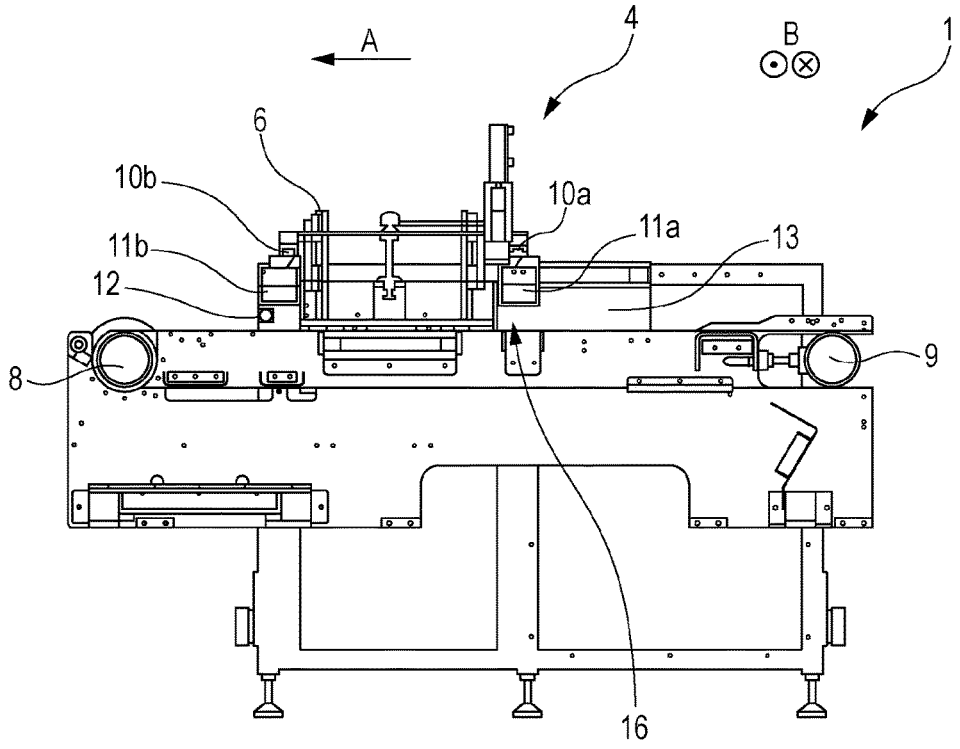
FIG. 4 is a schematic side view which illustrates the recording apparatus according to the embodiment of the invention.
Figure 5:
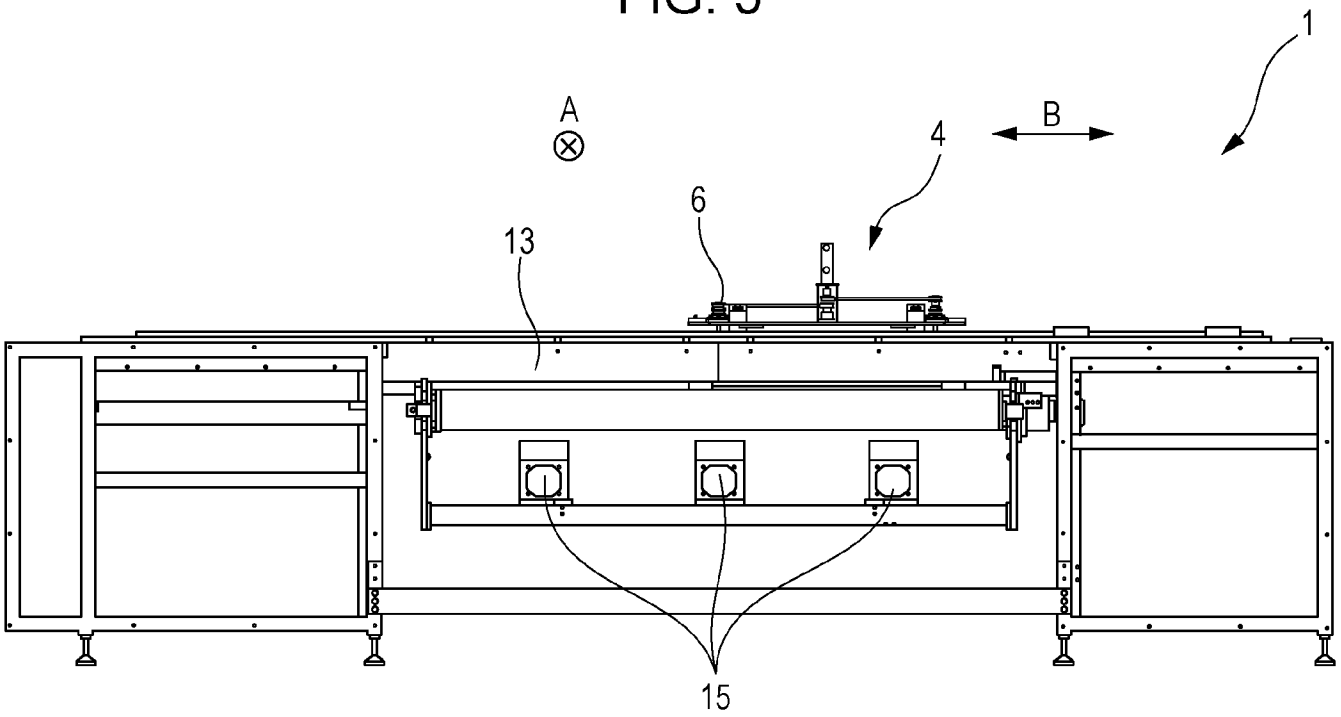
FIG. 5 is a schematic rear view which illustrates the recording apparatus according to the embodiment of the invention.
Figure 6:
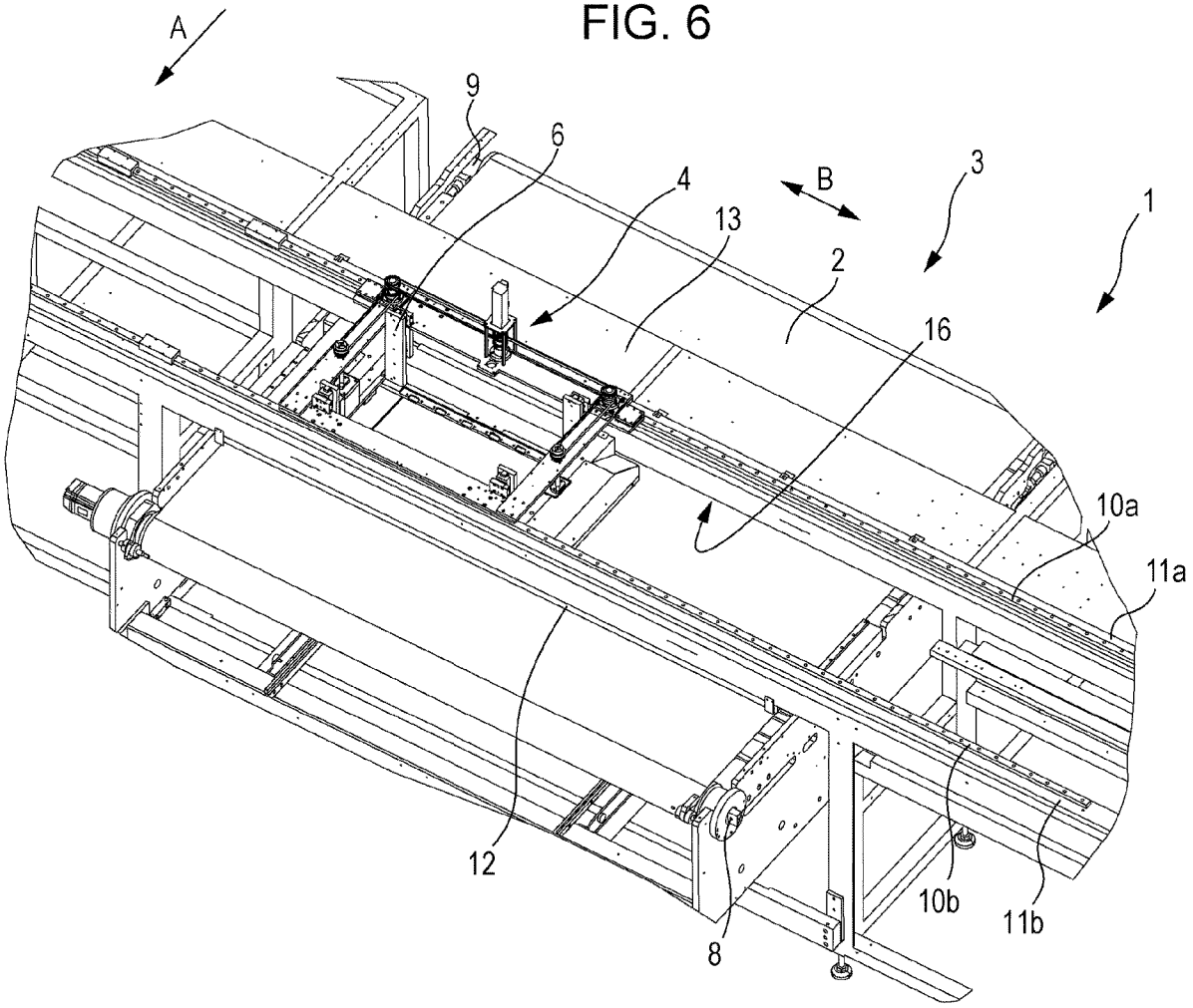
FIG. 6 is a schematic perspective view which illustrates main portions of the recording apparatus according to the embodiment of the invention.

FIG. 1 is a schematic perspective view of a recording apparatus 1 according to the embodiment. FIG. 2 is a schematic plan view of the recording apparatus 1 according to the embodiment. FIG. 3 is a schematic front view of the recording apparatus 1 according to the embodiment. FIG. 4 is a schematic side view of the recording apparatus 1 according to the embodiment. FIG. 5 is a schematic rear view of the recording apparatus 1 according to the embodiment. In addition, FIG. 6 is a schematic perspective view which illustrates the periphery of a recording region which is the main portion of the recording apparatus 1 according to the embodiment. In addition, FIGS. 1 to 6 illustrate a state in which a part of constituent elements is detached from the recording apparatus 1 according to the embodiment, and for example, illustrate a state in which a sub-carriage 5 (refer to FIG. 13) including a recording head 7 (refer to FIG. 12) is detached from a carriage 6.

The recording apparatus 1 according to the embodiment includes a transport mechanism 3 which transports a medium for recording in a transport direction A using an adhesive belt 2 (endless belt) which supports the medium for recording (medium) on a support face to which an adhesive is attached. The recording apparatus further includes a feeding unit (not illustrated) on which a medium for recording in a roll shape can be set, and can feed the medium for recording to the transport mechanism 3. The recording apparatus further includes a recording mechanism 4 which performs recording by causing the carriage 6 which includes the recording head 7 as the ejecting unit to perform reciprocating scanning in a reciprocating direction B which intersects the transport direction A, in a transport region of the medium for recording using the transport mechanism 3. The recording apparatus further includes a winding mechanism (not illustrated) which can wind up the medium for recording on which recording is performed in the recording mechanism 4.

The transport mechanism 3 according to the embodiment includes the adhesive belt 2 which transports the medium for recording which is fed from the feeding unit by mounting the medium for recording thereon, a driving roller 8 which moves the adhesive belt 2, and a driven roller 9. The medium for recording is mounted on a support face of the adhesive belt 2 by being attached thereto.

However, an endless belt as a transport belt is not limited to the adhesive belt. For example, an electrostatic suctioning-type endless belt may be used.

The recording apparatus 1 according to the embodiment includes the transport mechanism 3 with such a configuration; however, it is not limited to the transport mechanism with such a configuration, and may be a transport mechanism with a configuration in which a medium for recording is transported by being supported by a movable support tray, or the like, or a configuration in which a medium for recording is transported using a pair of rollers, or the like. In addition, it may be a recording apparatus of a so-called flatbed type in which recording is performed by fixing a medium for recording to a support unit, and a recording head 7 is moved with respect to the fixed medium for recording.

The recording mechanism 4 includes a carriage motor 30 (refer to FIG. 7) which causes the carriage 6 including the recording head 7 which can eject ink (liquid) to reciprocate in the reciprocating direction B.

The recording apparatus 1 according to the embodiment performs recording by causing the carriage 6 which includes the recording head 7 to perform reciprocating scanning when performing recording; however, the transport mechanism 3 stops transporting of the medium for recording in the middle of recording scanning (in the middle of moving of carriage 6). In other words, when performing recording, reciprocating scanning of the carriage 6, and transporting of the medium for recording are alternately performed. That is, when performing recording, the transport mechanism 3 causes the medium for recording to be intermittently transported (intermittent movement of adhesive belt 2) corresponding to reciprocating scanning of the carriage 6.

In addition, a rail 10*a* which extends in the reciprocating direction B is formed in a pipe 11*a* which configures a skeleton portion of the recording apparatus 1 according to the embodiment, and a rail 10*b* which extends in the reciprocating direction B is formed in a pipe 11*b* which configures a skeleton portion of the recording apparatus 1 according to the embodiment. In addition, a movement of the carriage 6 according to the embodiment in the reciprocating direction B is guided by the rails 10*a* and 10*b*, since bearing units (not illustrated) are received in the rails 10*a* and 10*b*.

In addition, an air blowing unit 12 which extends in the reciprocating direction B, and blows air in a direction opposite to the transport direction A from a plurality of vents (not illustrated) is provided at a position on the lower part of the pipe 11*b*. In addition, a mist collecting unit 13 which extends in the reciprocating direction B, and can collect mist of ink which is ejected from the recording head 7 is provided at a position on the lower part of the pipe 11*a*. In addition, a collecting port 16 which extends in the reciprocating direction B is provided in the mist collecting unit 13 at the position on the lower part of the pipe 11*a*.

In addition, as illustrated in FIG. 3, a plurality of blower fans 14 (three) which generate a blasting force using the air blowing unit 12 are provided on the downstream side of the recording apparatus 1 according to the embodiment in the transport direction A. The air blowing unit 12 can blow air toward the collecting port 16 from the outside (position on downstream side in transport direction A) of the collecting unit 13 using the blast force which is generated by the blower fan 14. In addition, as illustrated in FIG. 5, a plurality of (three) suctioning fans 15 as a suctioning unit which generates an air current W4 (refer to FIG. 15) toward the inside of the collecting unit 13 from the collecting port 16, and toward the outside of the recording apparatus 1 from the inside of the collecting unit 13 are provided on the upstream side of the recording apparatus 1 according to the embodiment in the transport direction A.

Subsequently, an electrical configuration of the recording apparatus 1 according to the embodiment will be described.

Figure 7:
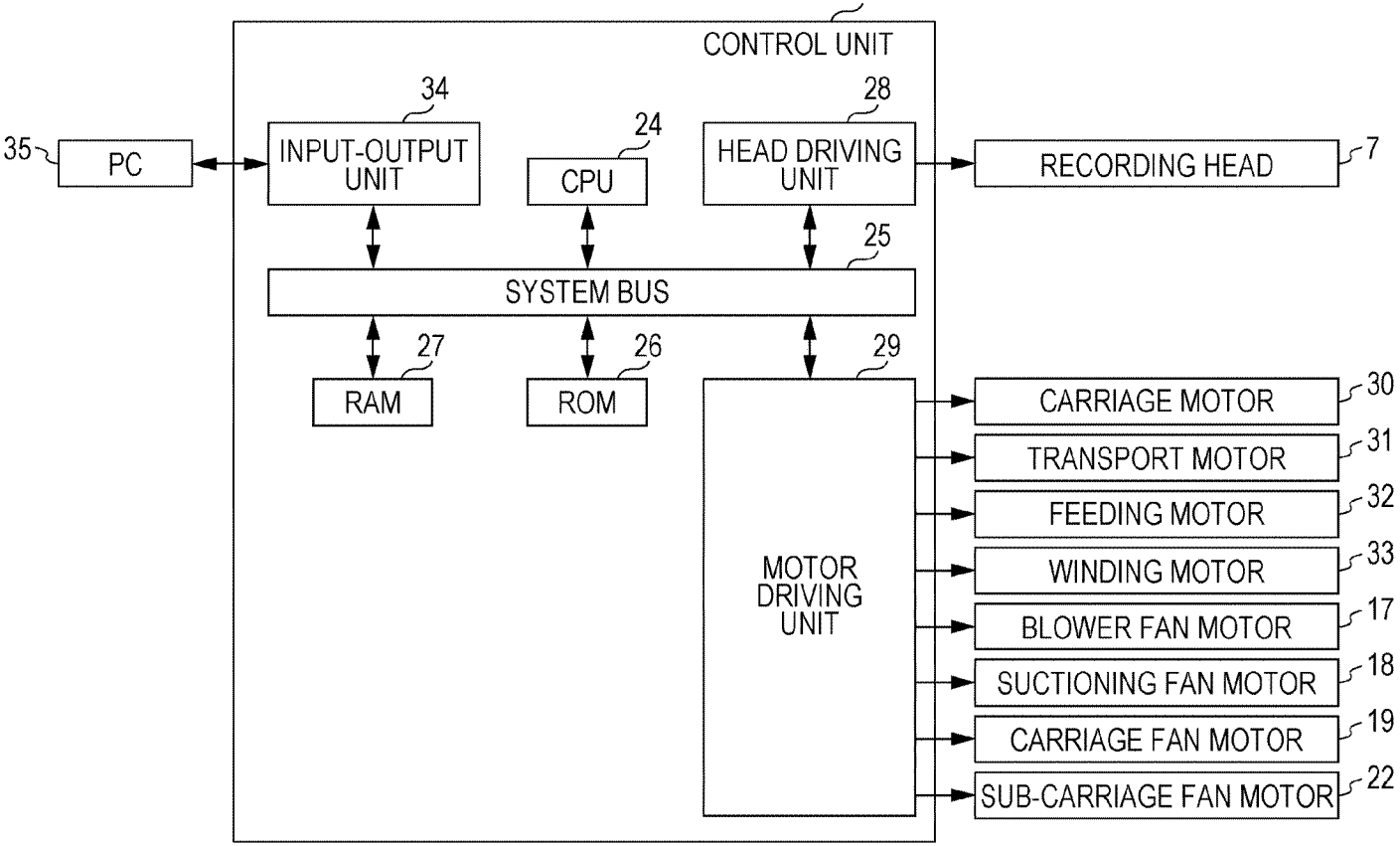
FIG. 7 is a block diagram which illustrates the recording apparatus according to the embodiment of the invention.

FIG. 7 is a block diagram of the recording apparatus 1 according to the embodiment.

A CPU 24 which is in charge of the entire control of the recording apparatus 1 is provided in a control unit 23. The CPU 24 is connected to a ROM 26 which stores various control programs, and the like, which are executed by the CPU 24, and a RAM 27 which can temporarily store data through a system bus 25.

In addition, the CPU 24 is connected to a head driving unit 28 which drives the recording head 7 through the system bus 25.

In addition, the CPU 24 is connected to a motor driving unit 29 for driving the carriage motor 30, a transport motor 31, a feeding motor 32, a winding motor 33, a blower fan motor 17, a suctioning fan motor 18, a carriage fan motor 19, and a sub-carriage fan motor 22 through the system bus 25.

Here, the carriage motor 30 is a motor for moving the carriage 6 including the recording head 7. In addition, the transport motor 31 is a motor for driving the driving roller 8. The feeding motor 32 is a driving motor of a feeding unit which blows out a medium for recording which is set in the feeding unit (not illustrated) to the transport mechanism 3. The winding motor 33 is a driving motor for driving a winding mechanism (not illustrated) in order to wind up a medium for recording on which recording is performed. The blower fan motor 17 is a motor for driving the blower fan 14. The suctioning fan motor 18 is a motor for driving the suctioning fan 15. The carriage fan motor 19 is a motor for driving a carriage fan 20 (refer to FIG. 8) which will be described later. In addition, the sub-carriage fan motor 22 is a motor for driving a sub-carriage fan 21 (refer to FIG. 13) which will be described later.

In addition, the CPU 24 is connected to an input-output unit 34 through the system bus 25, and the input-output unit 34 is connected to a PC 35 for performing transceiving of data such as recording data, and a signal.

Subsequently, the carriage 6 as a main portion of the recording apparatus 1 according to the embodiment will be described.

Figure 8:
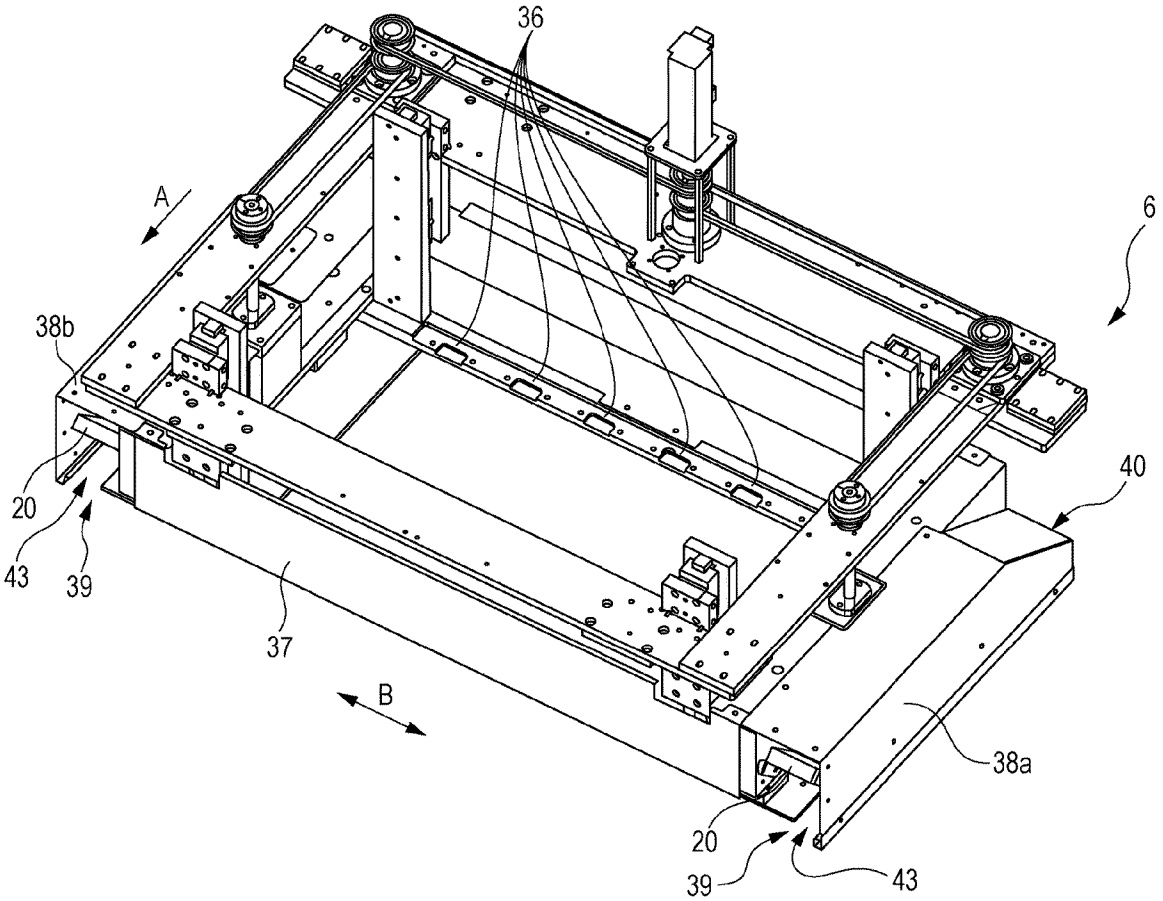
FIG. 8 is a schematic perspective view which illustrates a carriage of the recording apparatus according to the embodiment of the invention.
Figure 9:
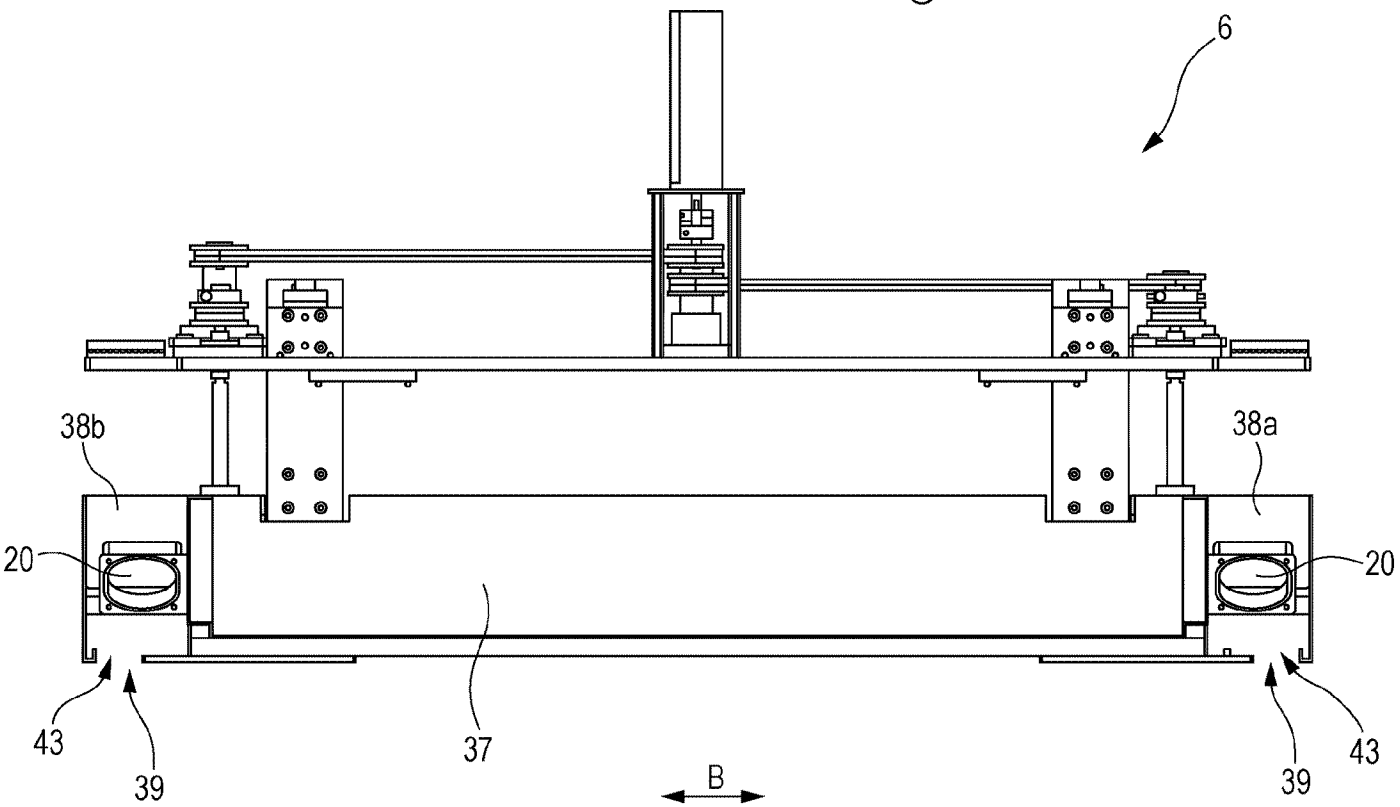
FIG. 9 is a schematic front view which illustrates the carriage of the recording apparatus according to the embodiment of the invention.
Figure 10B:
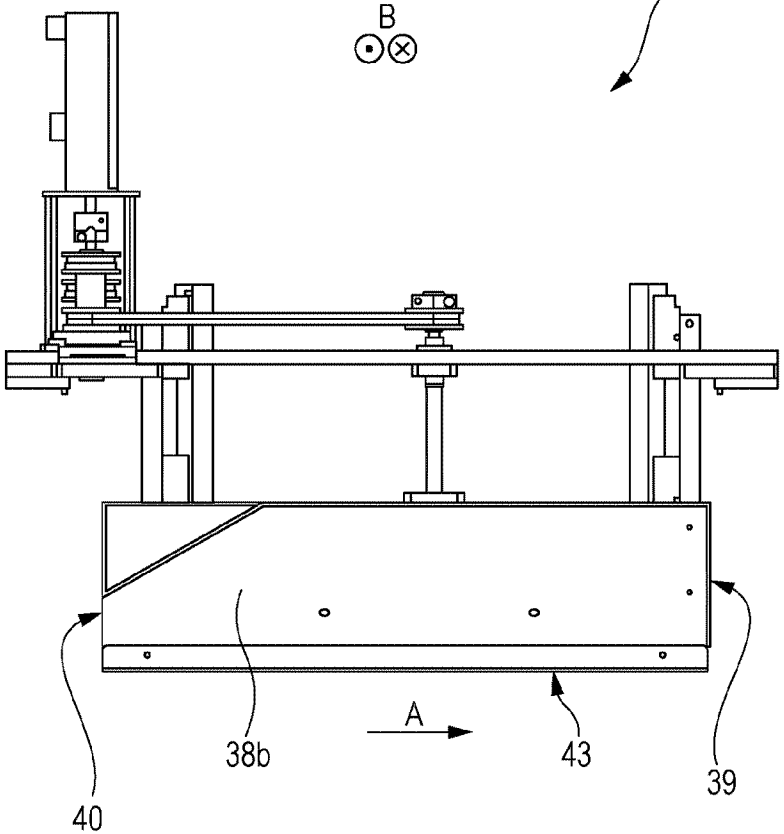
FIGS. 10A and 10B are schematic side views which illustrate the carriage of the recording apparatus according to the embodiment of the invention.
Figure 10A:
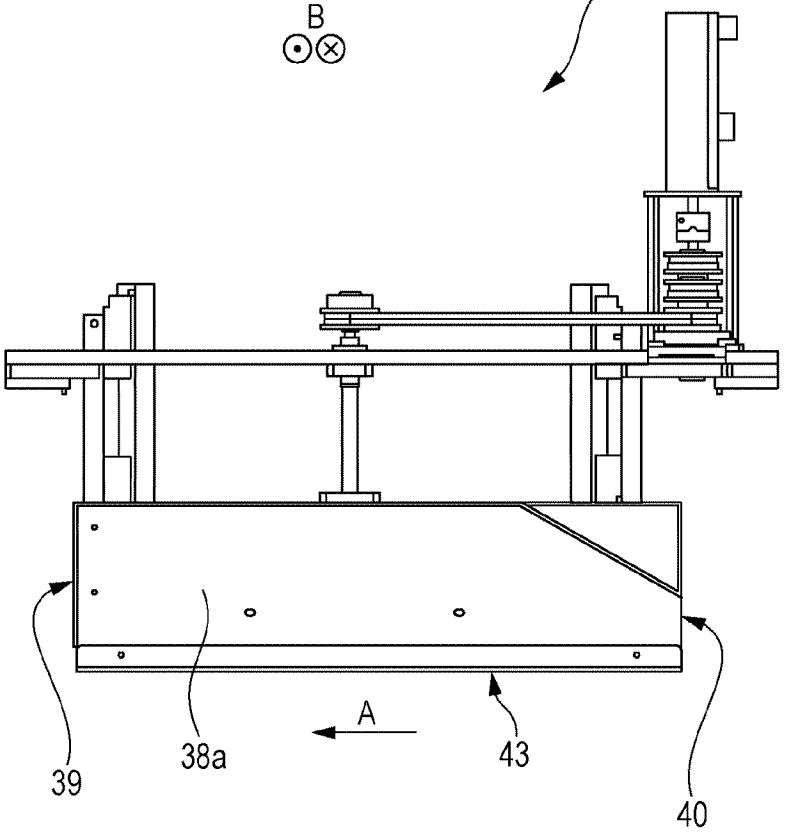
Figure 11:
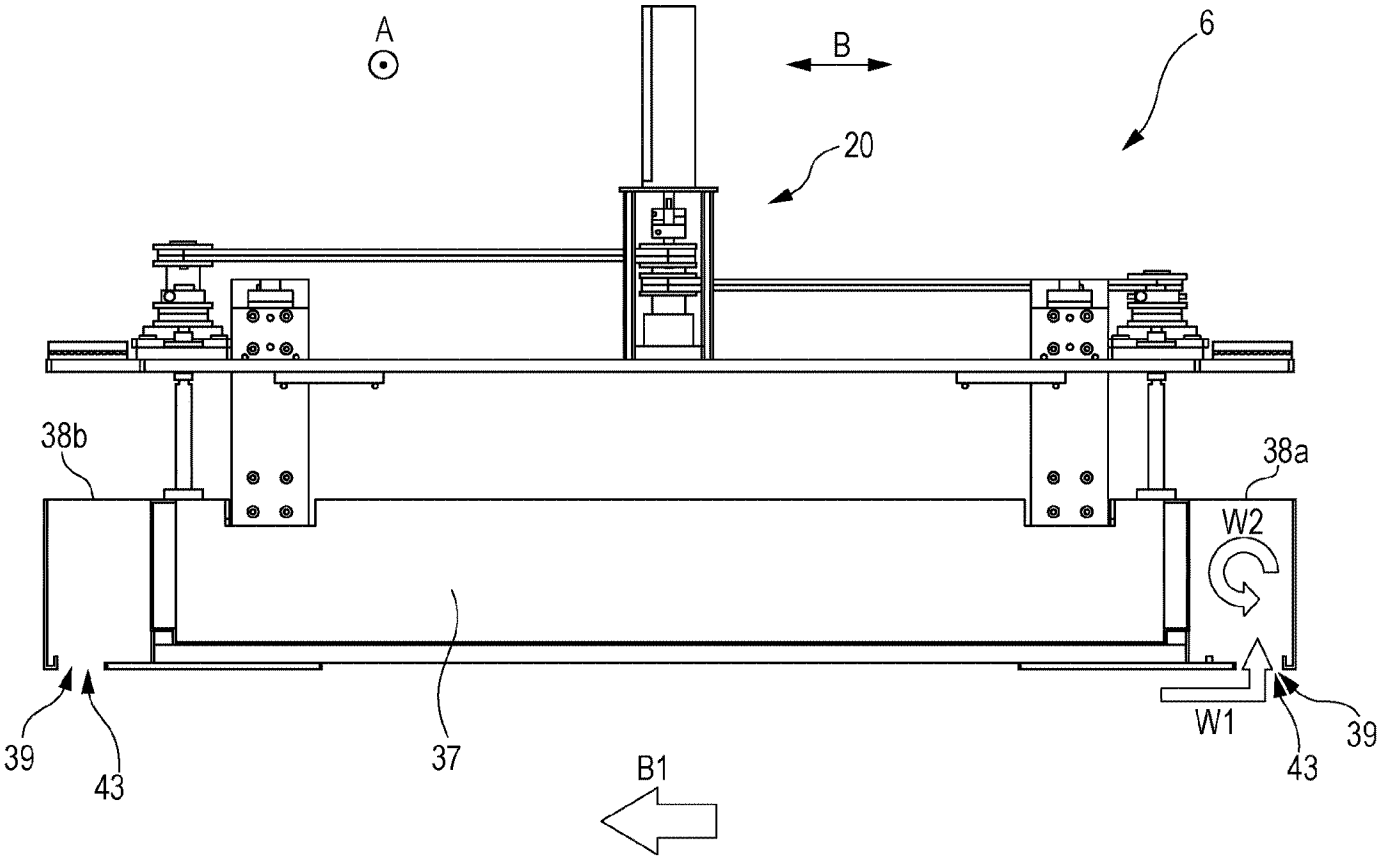
FIG. 11 is a schematic front view which illustrates the carriage of the recording apparatus according to the embodiment of the invention.
Figure 12:
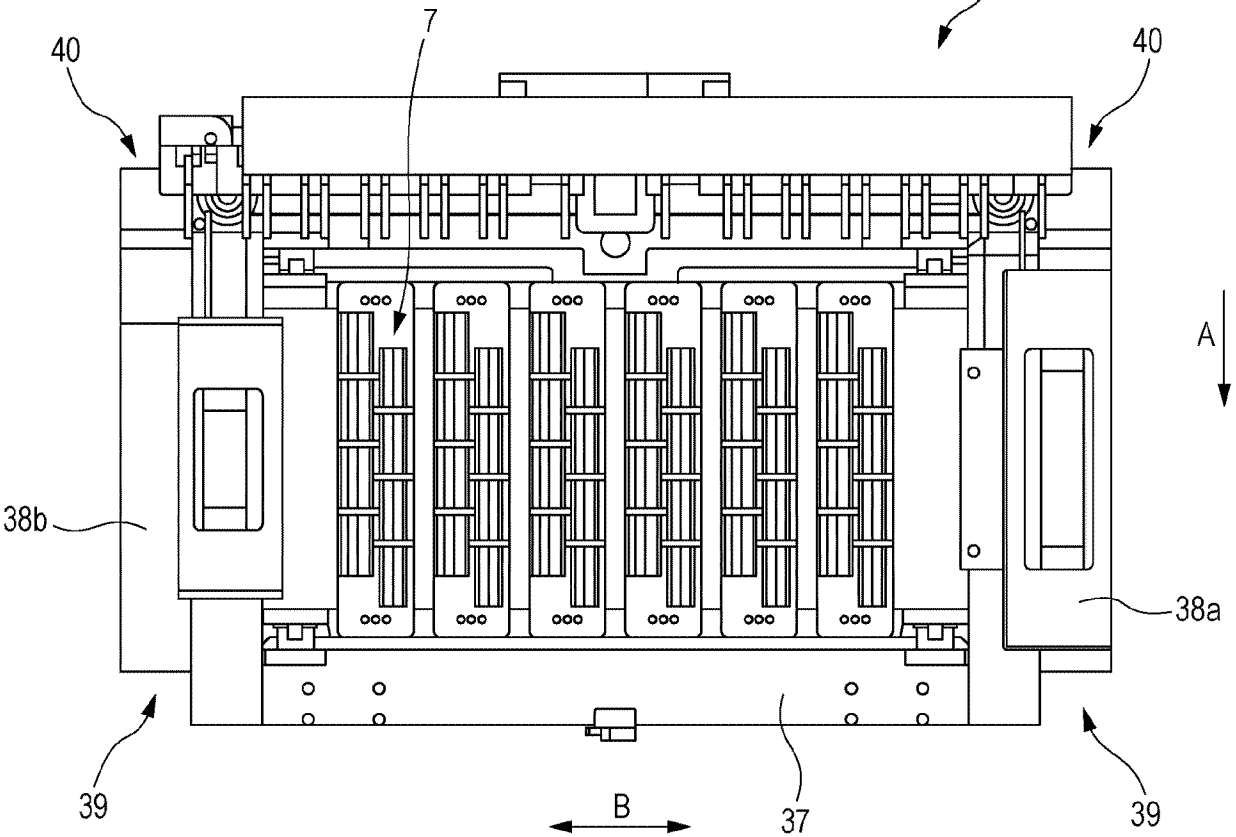
FIG. 12 is a schematic plan view which illustrates the carriage of the recording apparatus according to the embodiment of the invention.
Figure 13:
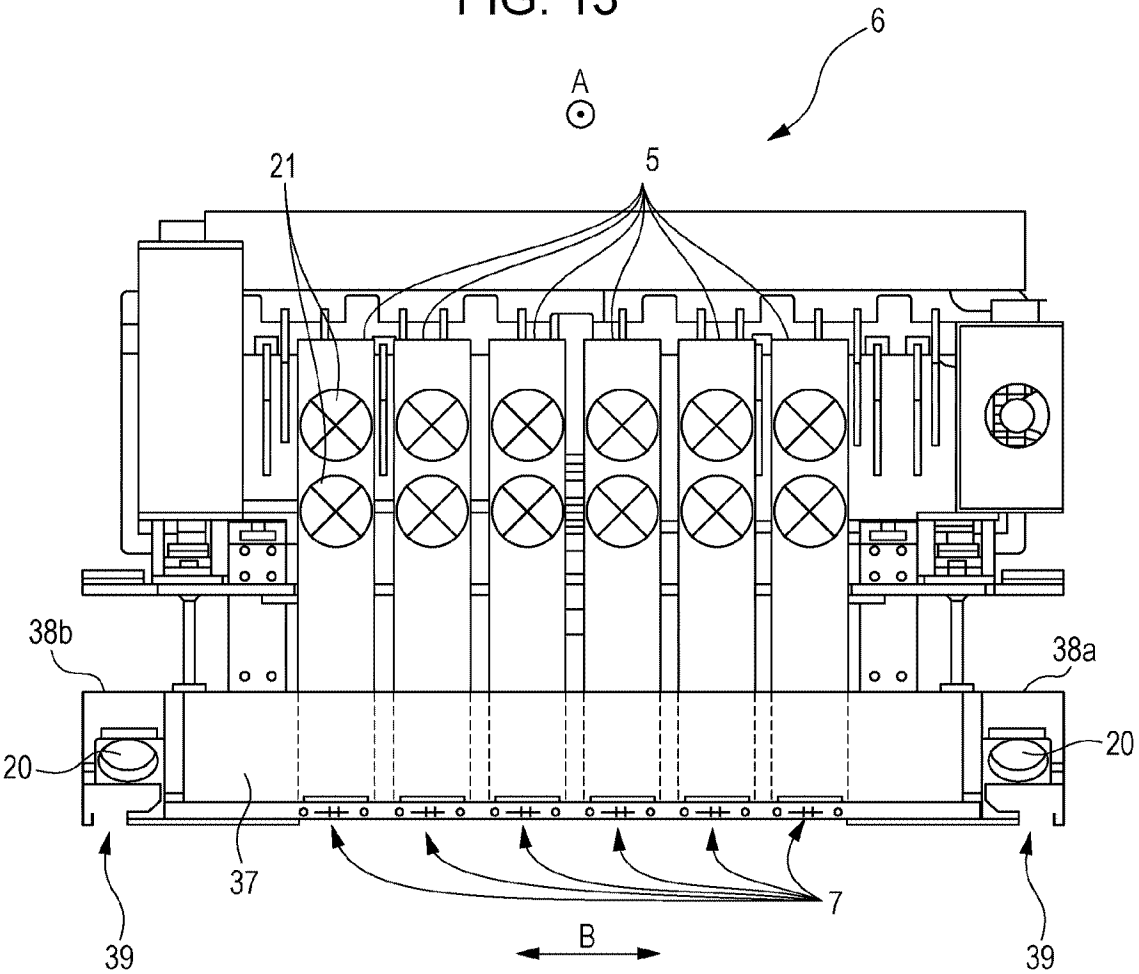
FIG. 13 is a schematic front view which illustrates the carriage of the recording apparatus according to the embodiment of the invention.
Figure 14:
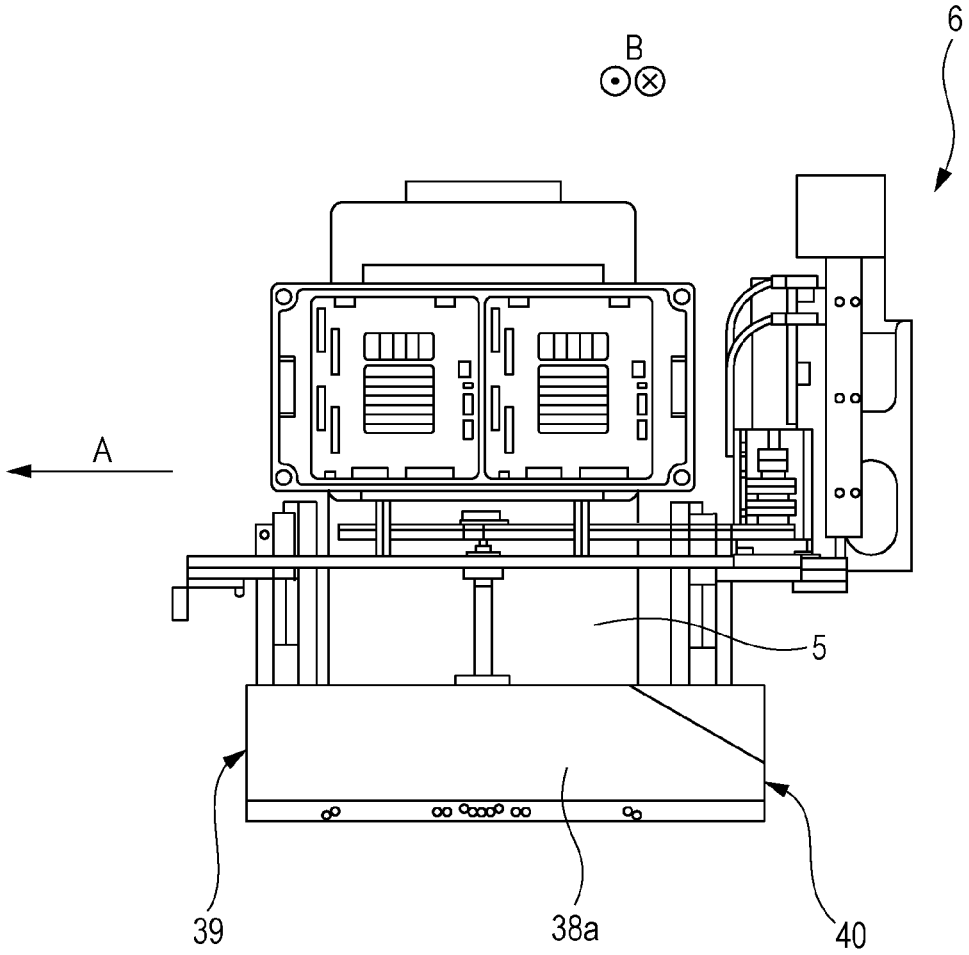
FIG. 14 is a schematic side view which illustrates the carriage of the recording apparatus according to the embodiment of the invention.

FIGS. 8 to 14 illustrate schematic views of the carriage 6 according to the embodiment. Among these, FIG. 8 illustrates a schematic perspective view of the carriage 6 according to the embodiment, FIGS. 9, 11, and 13 illustrate schematic front views of the carriage 6 according to the embodiment, FIGS. 10A, 10B, and 14 illustrate schematic side views of the carriage 6 according to the embodiment, and FIG. 12 illustrates a schematic plan view of the carriage 6 according to the embodiment. In addition, FIGS. 8 to 11 illustrate a state in which a part of constituent elements, for example, a sub-carriage 5 including the recording head 7 is detached from the carriage 6. In addition, FIG. 11 illustrates a state in which the carriage fan 20 is detached from catching units 38*a* and 38*b* of mist which are main portions, in order to describe an air current which is generated along with movement of the carriage 6. In addition, FIGS. 12 to 14 illustrate a state in which a plurality of the sub-carriages 5 including the recording head 7 are attached to the carriage 6, and FIG. 12 is set to a perspective view so that it is possible to understand arrangements of the plurality of recording heads 7 which are provided in each sub-carriage 5. In addition, FIG. 10A in FIGS. 10A and 10B is a schematic side view on the right side when viewing the carriage 6 on the front side, and FIG. 10B is a schematic side view on the left side when viewing the carriage 6 on the front side.

As illustrated in FIGS. 12 and 13, the carriage 6 according to the embodiment can be attached with the plurality of (six) sub-carriages 5. In addition, as illustrated in FIG. 12, the plurality of recording heads 7 are arranged in a staggered manner in each sub-carriage 5. In addition, a substrate, or the like, is formed in the inside of each sub-carriage 5, in addition to the plurality of recording heads 7, and the sub-carriage fan 21 for cooling the substrate is provided in the sub-carriage.

Since the sub-carriage fan 21 suppresses an increase in temperature in the sub-carriage 5 by blowing (air blowing) an air current in the inside of the sub-carriage 5, when mist of ink is present around the sub-carriage fan 21, the mist is sent to the inside of the sub-carriage 5, and there is concern that the mist may be attached to the substrate, or the like.

For this reason, in the recording apparatus 1 according to the embodiment, the air blowing unit 12 and the collecting unit 13 are provided, in addition to the catching units 38*a* and 38*b* of mist, in order to suppress attaching of mist to the substrate, or the like.

In addition, an attaching unit 36 of the sub-carriage 5 is provided in the carriage 6 according to the embodiment, as illustrated in FIG. 8.

In addition, as illustrated in FIGS. 8, 9, 11, 12, and 13, a frame-shaped unit 37 for suppressing attaching of mist of ink which is ejected from the recording head 7, which flies up to the higher part, to the sub-carriage 5 is provided. The frame-shaped unit 37 plays a role as a separator which maintains the region on the higher part of the sub-carriage 5 so as to be a region with little mist, by suppressing soaring up of mist with respect to a region which is close to the recording head 7, and has a lot of mist.

In addition, as illustrated in FIGS. 8 to 14, mist catching units 38*a* and 38*b* in which the carriage fan 20 is provided are provided on the outer side of the frame-shaped unit 37 in the reciprocating direction B.

Here, as illustrated in FIG. 11, an air current W1 is generated on the rear side in the direction B1 in the reciprocating direction B, during movement of the carriage 6 in the direction B1 in the reciprocating direction B. In addition, as illustrated in FIG. 11, a convection current W2 is generated in the catching unit 38*a* on the rear side in the direction B1 of the frame-shaped unit 37 along with movement of the carriage 6 during the movement in the direction B1. That is, it is a configuration in which it is possible to capture mist using the catching units 38*a* and 38*b* by moving the carriage 6.

In other words, the recording apparatus 1 according to the embodiment includes the recording head 7 which ejects ink onto a medium for recording, and the carriage 6 which can reciprocate in the reciprocating direction B; however, the carriage 6 includes the catching units 38*a* and 38*b* which capture mist which occurs along with ejecting of ink from the recording head 7 at both end portions (position overlapping with recording head 7 when viewed in the reciprocating direction B) in the reciprocating direction B. In addition, the catching units 38*a* and 38*b* include the carriage fan 20 which moves mist toward the collecting unit 13 from the catching units 38*a* and 38*b* by generating an air current W3 (refer to FIG. 15).

For this reason, it is a configuration in which it is possible to catch mist which occurs when ink is ejected from the recording head 7 along with reciprocating of the carriage 6 immediately after the occurrence of the mist using the catching units 38*a* and 38*b* which are provided in the carriage 6. In addition, since the catching units 38*a* and 38*b* include the carriage fan 20 which moves mist toward the collecting unit 13 from the catching units 38*a* and 38*b* by generating the air current W3, it is also possible to suppress a malfunction which is caused when the catching units 38*a* and 38*b* themselves are contaminated due to mist.

In addition, the carriage 6 according to the embodiment includes the catching units at both end portions in the reciprocating direction B; however, the carriage may include the catching unit on at least one side of the recording head 7 in the reciprocating direction B. In addition, the recording apparatus 1 according to the embodiment can also drive the carriage fans 20 of both of the catching units 38*a* and 38*b* at a time of a movement of the carriage 6 in any one direction in the reciprocating direction B under control of the control unit 23; however, it is not limited to such a driving method of the carriage fan 20. However, it is preferable to execute a driving method in which the carriage fan 20 on the rear side in the reciprocating direction B of the carriage 6 is driven.

In addition, as illustrated in FIGS. 8 to 11, the catching units 38*a* and 38*b* according to the embodiment extend in the transport direction A as an intersecting direction which intersects the reciprocating direction B, and are provided with a catching port 43 on a side which faces the medium for recording (lower side in vertical direction). For this reason, it is possible to catch mist over a wide range in the transport direction A, and from the lower side which is a side facing the medium for recording in which a lot of mist floats. Accordingly, it is possible to efficiently catch mist of ink which occurs along with ejecting of the ink from the recording head 7 immediately after the occurrence of the mist.

In addition, the catching port 43 according to the embodiment is a long opening which goes along the transport direction A, and is configured as a continuous opening of which an opening direction is different from that of an the outlet 40; however, it is not limited to such a configuration, and for example, it may be a configuration in which the catching port 43 is provided with a plurality of holes along the transport direction A, or the opening may be separated by providing a lid member in a boundary region between the catching port 43 and the outlet 40.

Subsequently, the collecting unit 13 of the recording apparatus 1 according to the embodiment will be described.

Figure 15:
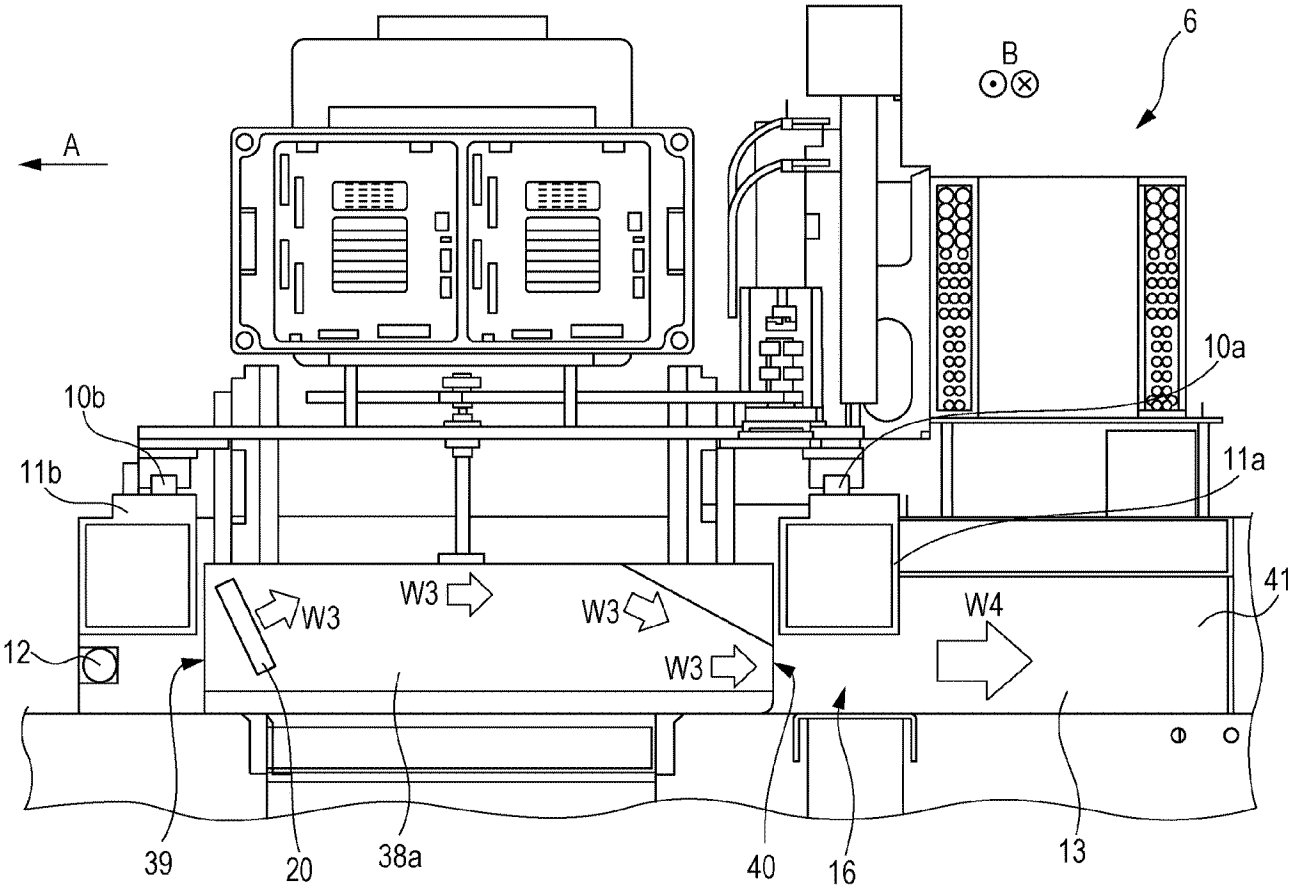
FIG. 15 is a schematic side sectional view which illustrates main portions of the recording apparatus according to the embodiment of the invention.
Figure 16:
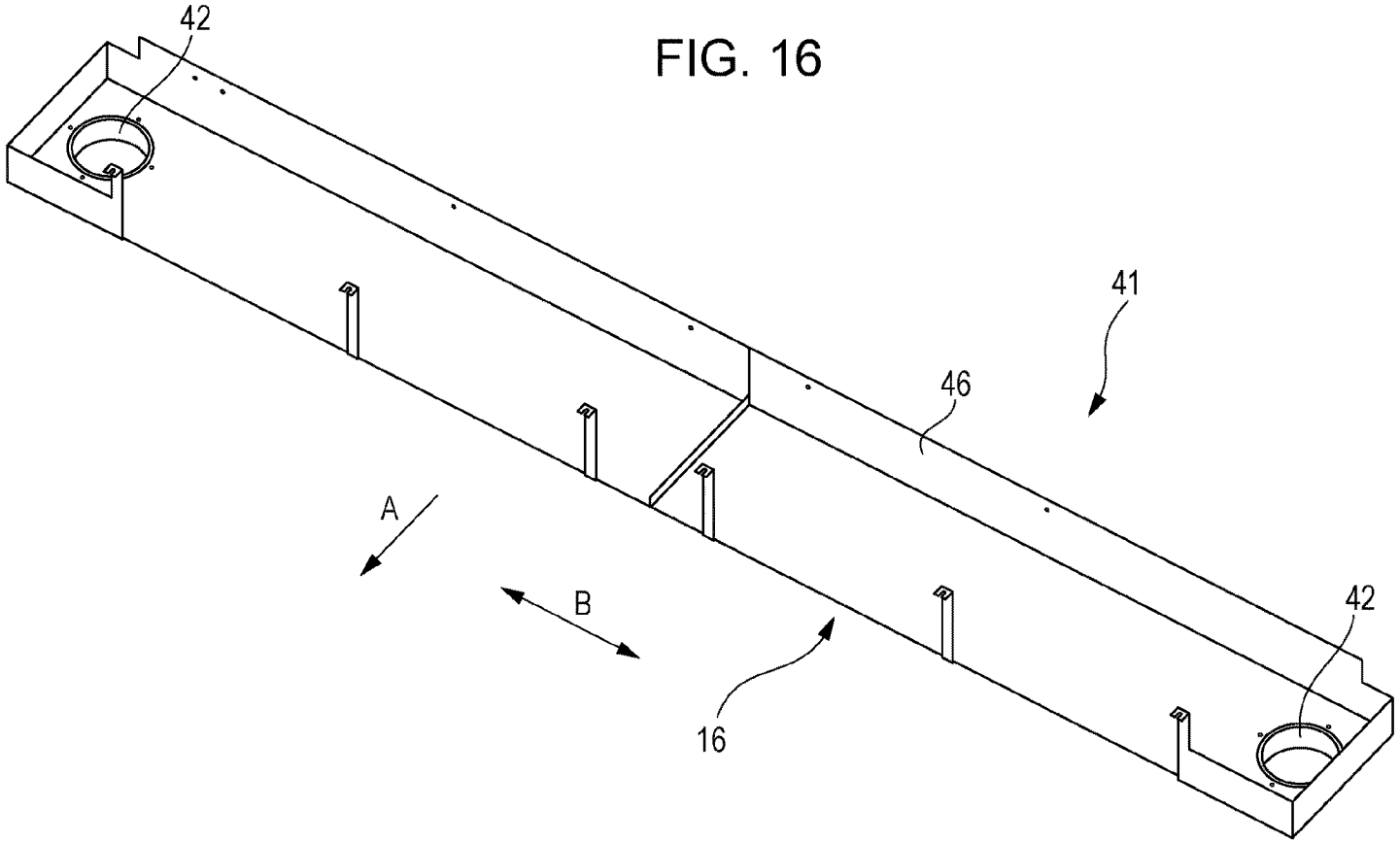
FIG. 16 is a schematic perspective view which illustrates a collecting unit of the recording apparatus according to the embodiment of the invention.
Figure 17:
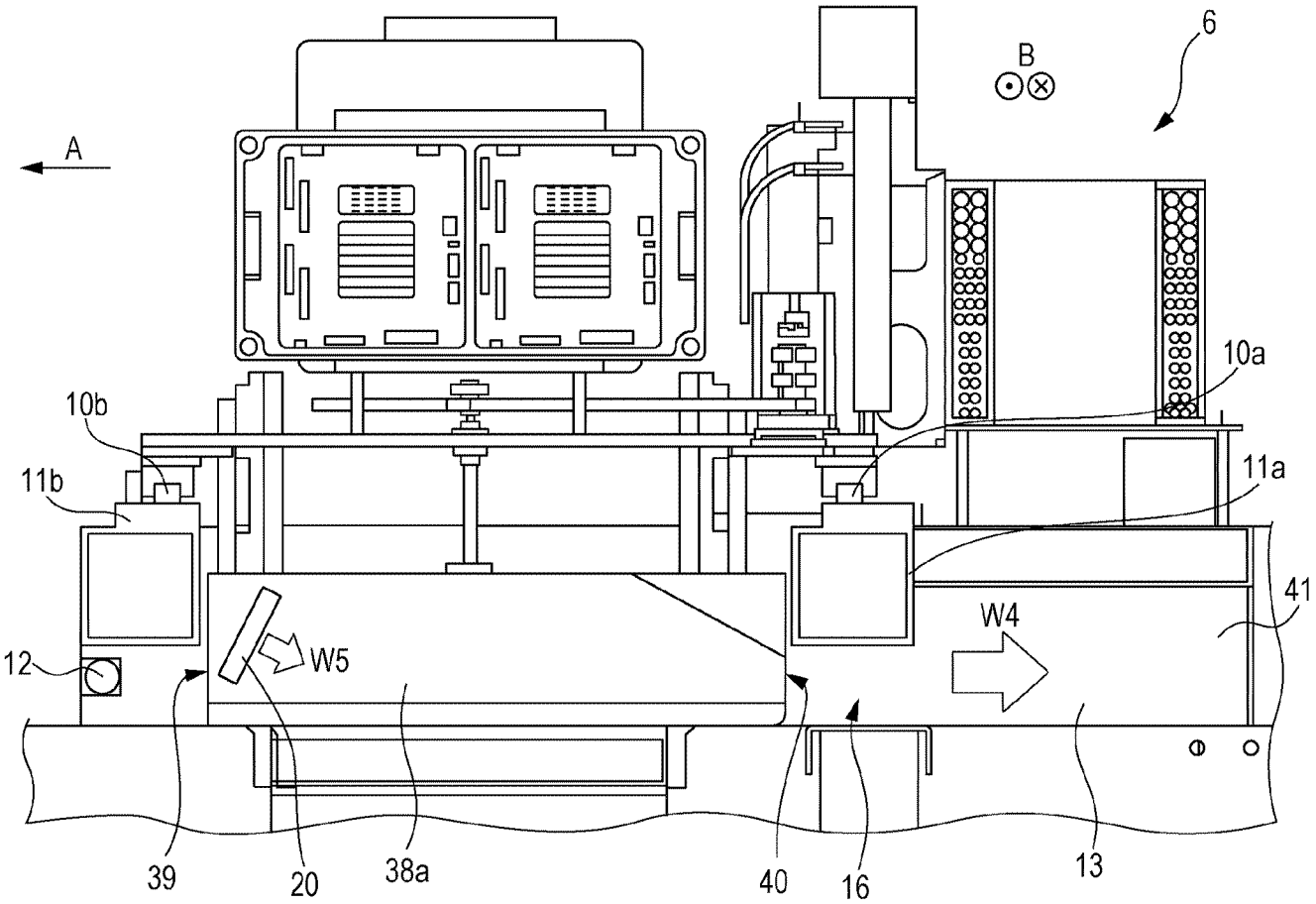
FIG. 17 is a schematic side sectional view which illustrates main portions of a recording apparatus in a comparison example.
Figure 18:
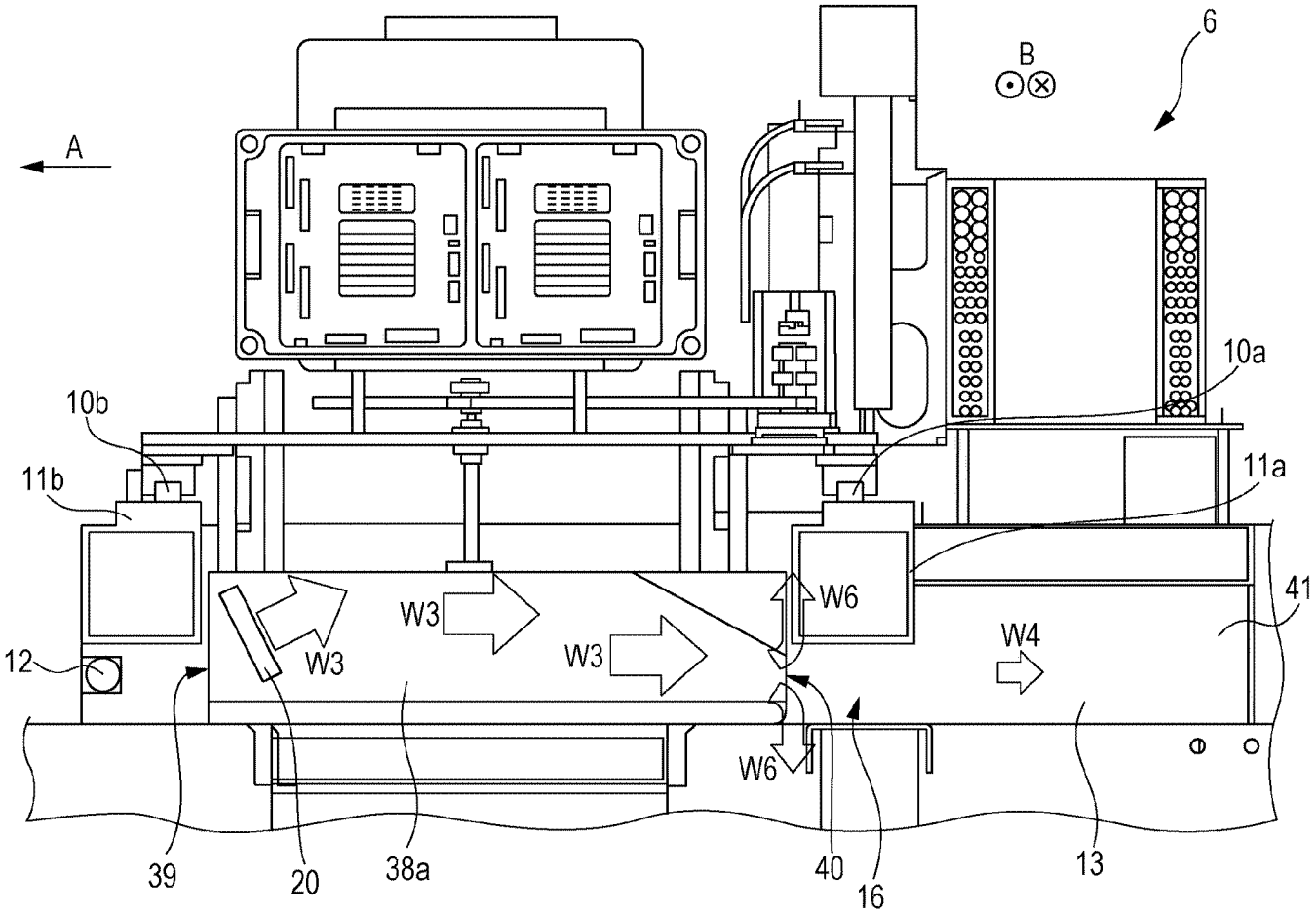
FIG. 18 is a schematic side sectional view which illustrates main portions of a recording apparatus in a comparison example.

Here, FIG. 15 is a schematic side sectional view of main portions of the recording apparatus 1 according to the embodiment for describing a positional relationship among the collecting unit 13, the carriage 6, and the air blowing unit 12. FIG. 16 is a schematic perspective view which illustrates a collecting chamber 41 in the collecting unit 13. In addition, FIGS. 17 and 18 are schematic side-sectional views of a recording apparatus 1 in a comparison example which is used for describing main portions of the recording apparatus 1 according to the embodiment, and correspond to FIG. 15.

As illustrated in FIG. 15, in the transport direction A, the air blowing unit 12 which can blow an air current toward the upstream side in the transport direction A is provided on the downstream side of a movement region (corresponding to recording region) of the carriage 6 in the reciprocating direction B. In addition, the collecting unit 13 is provided on the upstream side of the movement region. By arranging the collecting unit 13 in this manner, it is possible to efficiently collect mist of ink which occurs in the recording region.

In other words, the recording apparatus 1 according to the embodiment includes the collecting unit 13 of mist on the downstream side in the movement direction of mist using the carriage fan 20, can collect mist which is caught using the catching units 38*a* and 38*b*, and can prevent the inside of the recording apparatus 1, the medium for recording, or the like, from being contaminated due to mist which is caught using the catching units 38*a* and 38*b*.

More specifically, as illustrated in FIG. 15, in the main portions of the recording apparatus 1 according to the embodiment, the carriage fan 20 is provided on one end side (opening portion 39 side on downstream side) in the transport direction A as the intersecting direction which intersects the reciprocating direction B, and can blow air toward the other end side (opening portion 40 side on upstream side) from the one end side. That is, the carriage fan 20 generates an air current which is sent from the carriage fan 20 side, not an air current which is attracted to the carriage fan 20 side. For this reason, it is possible to efficiently collect mist of ink which occurs in the recording region while preventing the carriage fan 20 from being contaminated due to mist.

In addition, as illustrated in FIG. 15, the carriage fan 20 according to the embodiment can blow the air current W3 which goes toward a direction far from the medium for recording. Specifically, the air current W3 is sent toward the top face side in the catching units 38*a* and 38*b* using the carriage fan 20 which is provided on the opening portion 39 side on the downstream side in the transport direction A, and the air current W3 goes toward the collecting unit 13 from the opening portion 40 on the upstream side in the transport direction A along the top face. Here, for example, as illustrated in FIG. 17, when the carriage fan 20 can blow an air current W5 which goes toward the medium for recording, there is a case in which the medium for recording is contaminated due to mist which is included in the air current W5. Meanwhile, since the carriage fan 20 according to the embodiment has a configuration of blowing air toward a direction far from the medium for recording, it is possible to prevent the medium for recording from being contaminated due to mist.

In addition, as described above, the recording apparatus 1 according to the embodiment includes the collecting port 16 of mist, and the suctioning fan 15 as the suctioning unit which generates the air current W4 from the collecting port 16 toward the inside of the collecting unit 13, in the collecting unit 13.

In addition, as illustrated in FIG. 15, a wind velocity of the air current W3 which goes toward the collecting port 16 using the carriage fan 20 is adjusted so as to be lower than a wind velocity of the air current W4 which goes toward the inside of the collecting unit 13 from the collecting port 16 using the suctioning fan 15.

That is, the recording apparatus 1 according to the embodiment sets the wind velocity of the air current W4 which goes toward the inside of the collecting unit 13 from the collecting port 16 to be higher than the wind velocity of the air current W3 which goes toward the collecting port 16 from the outside of the collecting unit 13 based on a position of the collecting port 16. Here, for example, as illustrated in FIG. 18, when the wind velocity of the air current W3 is adjusted so as to be higher than that of the air current W4, there is a case in which the air current W3 including mist generates a remaining air current W6 which is incapable of entering the collecting unit 13. For this reason, the recording apparatus 1 according to the embodiment suppresses a situation in which the air current W3 including mist is incapable of entering the collecting unit 13 as a whole, by adjusting the wind velocity of the air current W3 so as to be lower than that of the air current W4.

In addition, as illustrated in FIG. 15, the catching units 38*a* and 38*b* according to the embodiment are formed in a tapered shape on the downstream side in the movement direction of mist using the carriage fan 20 (length in height direction becomes small toward opening portion 40 on upstream side in transport direction A). For this reason, it is possible to blow mist toward the collecting unit 13 with high accuracy.

In the recording apparatus 1 according to the embodiment, the carriage fan 20 can be driven so that a wind velocity when the carriage 6 is stopped is higher than a wind velocity when the carriage 6 is moving in the reciprocating direction B due to a control of the control unit 23. That is, it is possible to remove mist in the catching units 38*a* and 38*b* at once, using a high wind velocity in the middle of stopping of the carriage 6 in which there is no shift in ink ejecting position.

As described above, the recording apparatus 1 according to the embodiment includes the suctioning fan 15, as illustrated in FIG. 5, and the suctioning fan 15 is connected to the collecting chamber 41 through a duct 42 which is illustrated in FIG. 16. In other words, the collecting unit 13 includes the suctioning fan 15 as the suctioning unit which generates an air current from the collecting port 16 toward the inside of the collecting unit 13. For this reason, the recording apparatus 1 according to the embodiment can preferably prevent mist from flowing back from the collecting unit 13.

As described above, the recording apparatus 1 according to the embodiment can efficiently induce mist toward the collecting unit 13, since the air blowing unit 12 which blows air toward the collecting port 16 from the outside of the collecting unit 13 is provided.

The air blowing unit 12 stops blowing air during movement (during recording) of the carriage 6 (recording head 7) in the reciprocating direction B due to control of the control unit 23. For this reason, it is possible to suppress an occurrence of a shift in ejecting position of ink which is ejected from the recording head 7 due to an air current which is generated by the air blowing unit 12.

In addition, the recording apparatus 1 according to the embodiment sets a wind velocity of the air current W4 which goes toward the inside of the collecting unit 13 from the collecting port 16 to be higher than a wind velocity of an air current which is generated by the air blowing unit 12. For this reason, the recording apparatus 1 according to the embodiment suppresses a situation in which the air current including mist which is generated by the air blowing unit 12 is incapable of entering the collecting unit 13 as a whole.

As described above, the recording apparatus 1 according to the embodiment has a configuration in which the recording head 7 can eject ink while reciprocating in the reciprocating direction B; however, the suctioning fan 15 can maintain a suctioning state in both situations of in the middle of moving in the reciprocating direction B and in the middle of stopping of the carriage 6 (recording head 7) under a control of the control unit 23. That is, it is possible to set the suctioning fan 15 to a constant suctioning state. Since there is no shift in ink ejecting position even when an air current is generated in the collecting unit 13 using the suctioning fan 15, the recording apparatus 1 according to the embodiment can preferably suppress flowing back of ink mist from the collecting unit 13 while suppressing a shift in ejecting position of ink which is ejected from the recording head 7 by setting the suctioning fan 15 to the constant suctioning state.

As illustrated in FIG. 15, the collecting unit 13 according to the embodiment has a configuration in which the collecting chamber 41 is formed by mounting the pipe 11*a* which configures a top face on a base portion 46 which is illustrated in FIG. 16, which configures a constituting region of the collecting port 16, and each face other than a top face; however, it is not limited to such a configuration.

In addition, the invention is not limited to the above described embodiment, and it is needless to say that the invention can be variously modified in the scope of the invention which is described in claims, and those are also included in the scope of the invention.

Hitherto, the invention has been described based on specific embodiments. Here, the invention will be collectively described once again.

The liquid ejecting apparatus 1 according to a first aspect of the invention includes an ejecting unit 7 which ejects liquid onto a medium, includes the carriage 6 which can move in the reciprocating direction B, in which the carriage 6 includes the catching units 38*a* and 38*b* which catch mist which occurs along with ejecting of the liquid from the ejecting unit 7 on at least one side of the ejecting unit 7 in the reciprocating direction B, and the catching units 38*a* and 38*b* include a fan 20 which moves the mist from the catching units 38*a* and 38*b* by generating the air current W3.

According to the aspect, the carriage 6 includes the catching units 38*a* and 38*b* which catch mist which occurs along with ejecting of liquid from the ejecting unit 7 on at least one side of the ejecting unit 7 in the reciprocating direction B. For this reason, it is possible to catch mist of liquid which occurs along with ejecting of the liquid from the ejecting unit 7 which is associated with reciprocating of the carriage 6 immediately after the occurrence, using the catching units 38*a* and 38*b* which are provided in the carriage 6. In addition, since the catching units 38*a* and 38*b* include the fan 20 which moves mist from the catching units 38*a* and 38*b* by generating the air current W3, it is possible to suppress a malfunction which is caused when the catching units 38*a* and 38*b* themselves are contaminated due to the mist.

In the liquid ejecting apparatus 1 according to a second aspect of the invention, in the first aspect, the catching units 38*a* and 38*b* are extended in an intersecting direction A which intersects the reciprocating direction B, and in which a catching port 43 is provided on a side facing the medium.

According to the aspect, the catching units 38*a* and 38*b* are extended in the intersecting direction A, and the catching port 43 is provided on the side facing the medium. For this reason, it is possible to catch mist over a wide range in the intersecting direction A, and the side which faces the medium on which a lot of mist floats. Accordingly, it is possible to efficiently catch mist of liquid which occurs along with ejecting of the liquid from the ejecting unit 7 immediately after the occurrence of the mist.

In the liquid ejecting apparatus according to a third aspect of the invention, in the second aspect, the fan 20 is provided on one end side in the intersecting direction A, and can blow air toward the other end side from the one end side.

According to the aspect, the fan 20 is provided on one end side in the intersecting direction A, and can blow air toward the other end side from the one end side. That is, the fan 20 generates an air current which is blown from the fan 20 side, not an air current which is attracted to the fan 20 side. For this reason, it is possible to prevent the fan 20 from being contaminated due to mist.

In the liquid ejecting apparatus 1 according to a fourth aspect of the invention, in any one of the first to third aspects, the fan 20 can blow air toward a direction far from the medium.

According to the aspect, the fan 20 can blow air toward a direction far from a medium. For this reason, it is possible to suppress contamination of the medium.

In the liquid ejecting apparatus 1 according to a fifth aspect of the invention, in any one of the first to fourth aspects, the collecting unit 13 of the mist is provided on the downstream side in a movement direction of the mist using the fan 20.

According to the aspect, the collecting unit 13 of mist is provided on the downstream side in the movement direction of mist using the fan 20. For this reason, it is possible to collect mist which is caught using the catching units 38*a* and 38*b*, and to prevent the inside of the liquid ejecting apparatus 1, the medium, or the like, from being contaminated due to the mist which is caught using the catching units 38*a* and 38*b*.

In the liquid ejecting apparatus 1 according to a sixth aspect of the invention, in the fifth aspect, the collecting unit 13 includes the collecting port 16 of the mist, and the suctioning unit 15 which generates an air current W4 from the collecting port 16 toward the inside of the collecting unit 13, in which a wind velocity of the air current W3 which goes toward the collecting port 16 using the fan 20 is lower than a wind velocity of the air current W4 which goes toward the inside of the collecting unit 13 from the collecting port 16 using the suctioning unit 15.

According to the aspect, the collecting unit 13 includes the collecting port 16 of mist, and the suctioning unit 15 which generates the air current W4 from the collecting port 16 toward the inside of the collecting unit 13, in which the wind velocity of the air current W3 which goes toward the collecting port 16 using the fan 20 is lower than the wind velocity of the air current W4 which goes toward the inside of the collecting unit 13 from the collecting port 16 using the suctioning unit 15. That is, it is set so that the wind velocity of the air current W4 which goes toward the inside of the collecting unit 13 from the collecting port 16 is higher than the wind velocity of the air current W3 which goes toward the collecting port 16 from the outside of the collecting unit 13 based on a position of the collecting port 16. For this reason, it is possible to suppress a situation in which the air current W3 including mist is incapable of entering the collecting unit as a whole.

In the liquid ejecting apparatus 1 according to a seventh aspect of the invention, in the fifth or sixth aspect, the catching units 38*a* and 38*b* are formed in a tapered shape on the downstream side in a movement direction of the mist using the fan 20.

According to the aspect, the catching units 38*a* and 38*b* are formed in the tapered shape on the downstream side in the movement direction of the mist using the fan 20. For this reason, it is possible to blow air toward the collecting unit 13 with high accuracy.

In the liquid ejecting apparatus 1 according to an eighth aspect of the invention, in any one of the first to seventh aspects, the fan 20 can be driven so that a wind velocity when the carriage 6 is stopped is higher than a wind velocity when the carriage 6 is moving in the reciprocating direction B.

According to the aspect, the fan 20 can be driven so that the wind velocity when the carriage 6 is stopped is higher than the wind velocity when the carriage 6 is moving in the reciprocating direction B. For this reason, it is possible to remove mist in the catching units 38*a* and 38*b* at once, using a high wind velocity in the middle of stopping of the carriage 6 in which there is no shift in ink ejecting position.

The entire disclosure of Japanese Patent Application No. 2015-064586, filed Mar. 26, 2015 is expressly incorporated by reference herein.

What is claimed is:

1. A liquid ejecting apparatus comprising:

a carriage which includes an ejecting unit which ejects liquid onto a medium, and is configured to move in a reciprocating direction, wherein the carriage includes a catching unit which catches mist which occurs along with ejecting of the liquid from the ejecting unit on at least one side of the ejecting unit in the reciprocating direction, and wherein the catching unit includes a fan which causes the mist to move from the catching unit by generating an air current, wherein the fan is configured to be driven so that a wind velocity when the carriage is stopped is higher than a wind velocity when the carriage is moving in the reciprocating direction.

2. The liquid ejecting apparatus according to claim 1, wherein the catching unit is extended in an intersecting direction which intersects the reciprocating direction, and a catching port is provided on a side facing the medium.

3. The liquid ejecting apparatus according to claim 2, wherein the fan is provided on one end side of the intersecting direction, and is configured to blow air toward the other end side from the one side.

4. The liquid ejecting apparatus according to claim 1, wherein the fan is configured to blow air toward a direction far from the medium.

5. The liquid ejecting apparatus according to claim 1, further comprising:

a collecting unit of the mist on the downstream side in a movement direction of the mist using the fan.

6. The liquid ejecting apparatus according to claim 5, wherein the collecting unit includes a collecting port of the mist, and a suctioning unit which generates an air current from the collecting port toward an inside of the collecting unit, and wherein a wind velocity of an air current which goes toward the collecting port using the fan is lower than a wind velocity of an air current which goes toward the inside of the collecting unit from the collecting port using the suctioning unit.

7. The liquid ejecting apparatus according to claim 5, wherein the catching unit is formed in a tapered shape on the downstream side in the movement direction of the mist using the fan.

8. A liquid ejecting apparatus comprising:

a carriage which includes an ejecting unit which ejects liquid onto a medium, and is configured to move in a reciprocating direction, wherein the carriage includes a catching unit which catches mist which occurs along with ejecting of the liquid from the ejecting unit on at least one side of the ejecting unit in the reciprocating direction, and wherein the catching unit includes a fan which causes the mist to move from the catching unit by generating an air current, wherein the liquid ejecting apparatus further comprises:

a collecting unit of the mist on the downstream side in a movement direction of the mist using the fan, wherein the collecting unit includes a collecting port of the mist, and a suctioning unit which generates an air current from the collecting port toward an inside of the collecting unit, and wherein a wind velocity of an air current which goes toward the collecting port using the fan is lower than a wind velocity of an air current which goes toward the inside of the collecting unit from the collecting port using the suctioning unit.

9. A liquid ejecting apparatus comprising:

a carriage which includes an ejecting unit which ejects liquid onto a medium, and is configured to move in a reciprocating direction, wherein the carriage includes a catching unit which catches mist which occurs along with ejecting of the liquid from the ejecting unit on at least one side of the ejecting unit in the reciprocating direction, and wherein the catching unit includes a fan which causes the mist to move from the catching unit by generating an air current, the fan being disposed only in a catching port of the catching unit.

10. A liquid ejecting apparatus comprising:

a carriage which includes an ejecting unit which ejects liquid onto a medium, and is configured to move in a reciprocating direction, wherein the carriage includes a catching unit which catches mist which occurs along with ejecting of the liquid from the ejecting unit on at least one side of the ejecting unit in the reciprocating direction, wherein the catching unit includes a fan which causes the mist to move from the catching unit by generating an air current, wherein the catching unit is extended along a side of the carriage in a transport direction of the medium which intersects the reciprocating direction of the carriage, and wherein a catching port is provided on a side facing the medium and orientated in the transport direction such that the mist enters the catching port in the transport direction.

* * * * *